United States Patent [19]

Mikolajczyk

[11] Patent Number: 4,825,947

[45] Date of Patent: May 2, 1989

[54] APPARATUS FOR USE IN CEMENTING A CASING STRING WITHIN A WELL BORE

[76] Inventor: Raymond F. Mikolajczyk, Rte. 1, Box 1032, Broussard, La. 70518

[21] Appl. No.: 154,930

[22] Filed: Feb. 11, 1988

Related U.S. Application Data

[63] Continuation-in-part of Ser. No. 924,929, Oct. 30, 1986, which is a continuation-in-part of Ser. No. 704,489, Feb. 22, 1985, abandoned.

[51] Int. Cl.[4] ..... E21B 17/10; E21B 33/14

[52] U.S. Cl. ..... 166/241; 166/328

[58] Field of Search ..... 166/241, 242, 325–329

[56] References Cited

U.S. PATENT DOCUMENTS

| | | | |
|---|---|---|---|
| Re. 18,651 | 11/1932 | Little | 166/327 |
| 1,460,632 | 7/1923 | Wigle et al. | 166/241 |
| 1,786,761 | 12/1930 | Little | 166/327 |
| 1,998,833 | 4/1935 | Crowell | 166/328 X |
| 2,253,415 | 8/1941 | Brodie | 166/327 |
| 2,295,803 | 9/1942 | O'Leary | 166/327 X |
| 2,654,435 | 10/1953 | Oliver | 166/327 |
| 2,730,177 | 1/1956 | Kline | 166/328 |
| 2,762,441 | 9/1956 | Newlin | 166/327 |

OTHER PUBLICATIONS

*Baker Oil Tools Catalog* June, 1930.

Arrow Oil Tools Brochure pp. 262–265 Composite Catalog of Oil Field Equipment and Services 1984.

Bakerline Brochure pp. 368–370 Composite Catalog of Oil Field Equipment and Services 1984.

Gemoco Brochure pages 3210, 3211 Composite Catalog of Oil Field Equipment and Services 1984.

Maxam Tool & Supply, Inc. Brochure pages 5054, 5055 Composite Catalog of Oil Field Equipment and Services 1984.

Industrial Rubber, Inc. Brochure pages 4434–4436 Composite Catalog of Oil Field Equipment and Services 1984.

Butler Larkin Co. Brochure page 1176 Composite Catalog of Oil Field Equipment and Services 1984.

Dowell Schlumberger Brochure page 2300 Composite Catalog of Oil Field Equipment and Services 1984.

Davis–Lynching Brochure page 2202 Composite Catalog of Oil Field Equipment and Services 1984.

Weatherford Brochure pages 7673, 7674 Composite Catalog of Oil Field Equipment and Services 1984.

*Primary Examiner*—Stephen J. Novosad

*Assistant Examiner*—David J. Bagnell

*Attorney, Agent, or Firm*—Vaden, Eickenroht, Thompson & Boulware

[57] ABSTRACT

There is disclosed apparatus either in the form of a float shoe or float collar for use in cementing a casing string within a well bore, the shoe or collar having blades extending longitudinally along the outer side thereof for centering the shoe or collar, and thus the lower end of the casing string, within the well bore.

4 Claims, 2 Drawing Sheets

APPARATUS FOR USE IN CEMENTING A CASING STRING WITHIN A WELL BORE

This application is a continuation-in-part of my copending application, Ser. No. 924,929, filed Oct. 30, 1986, and entitled "Casing Centralizer", which is in turn a continuation-in-part of my now abandoned application, Ser. No. 704,489, filed Feb. 22, 1985, and entitled "Casing Centralizer Stablilizer".

This invention relates in general to apparatus for use in cementing a casing string within a well bore. More particularly, it relates to improvements in apparatus of this type known as "float collars" and "float shoes".

Float collars and float shoes are of basically the same construction in that each is connectible as part of the casing string near (collars) or at (shoes) its lower end, and has valve means which permits flow downwardly but prevents flow upwardly through a vertical passageway. Ordinarily, as it is lowered into the well bore, the casing string is filled with drilling mud to prevent its collapse due to pressure of the drilling mud already in the well bore. However, it may not be filled completely so that, with the valve means closed, the drilling mud in the well bore has a bouyant effect to "float" the string into the well bore. In any event, when the string is lowered to total depth, pump pressure is applied to the string to open the valve means and thus to permit cement to be pumped through the string and into the annulus between the string and well bore.

Following addition of the desired volume of cement, a wiper plug is pumped down the string by means of mud or water until it bumps or lands on the float collar or shoe. At this time, the pumps are shut off to permit the valve means to close and thus to prevent cement from "U" tubing out of the annulus and back into the string before it hardens.

A conventional float collar or float shoe comprises an outer tubular body having an upper threaded end for connection to a joint of casing thereabove, and the valve means is mounted within an inner body formed of concrete or other material which may be drilled out, when the cement has hardened, to fully open the casing string throughout its length. More particularly, a sleeve of suitable plastic material having resistance to abrasion, corrosion and high temperatures is mounted within the inner body to provide a downwardly facing seat and an upwardly facing cage about the passageway, and a ball of equally durable material is shiftable vertically within the passageway for engaging the seat or cage to respectively open or close the passageway.

The outer tubular body of a float shoe is threaded at only its upper end for connection to the lowermost joint of the casing string, and the lower end of the inner body of concrete extends below the lower end of the outer body and is rounded to guide the lower end of the string through the well bore. The outer body of a float collar is threaded at its lower as well as at its upper end for connection as part of the casing string near its lower end.

It is of course desirable to maintain the casing string centered within the well bore as cement is pumped upwardly within the annulus in order to provide a cement column of substantially uniform thickness. Thus, if the string is not centered, the column of cement may not completely surround it such that well fluids may be free to channel or flow past the column. As a result, the cement column will not protect relatively weak shallow formations in the well bore from the heavier drilling muds used in drilling into deeper formations. Thus, upon drilling out the drillable inner body of the float collar or shoe, the operator will drill a short distance into the well bore and pressure test to determine if the cement column will hold the heavier mud pressure. If it does not, the operator must perform a secondary cement squeeze until the column will hold the necessary pressure. This of course is a considerable expense which could be avoided if the initial cement column was adequate to hold the pressure.

Casing strings are therefore centered by so-called "centralizers" which are connected as part of the casing string or disposed thereabout at desired intervals. For this purpose, centralizers have outwardly extending parts to engage the well bore, which parts have conventionally comprised bow strings extending lengthwise of the string and mounted at both ends to tightly engage the well bore, or metal strips welded to the body and bent to shapes which engage the well bore. However, my aforementioned copending patent application discloses and claims an improved centralizer having longitudinally extending metal blades cast as one piece with a collar disposable over a joint or casing.

Operators often install a centralizer in or about the casing string just above the float collar or float shoe as well as at spaced intervals thereabove in order to obtain a uniform column of cement about the casing string. This of course adds to the cost of the casing program and consumes valuable time required to make up the centralizer in the string.

Also, as the well bore is drilled out below the casing string, casing joints at the lower end of the string may become unscrewed from the portion of the casing string above them. As a result, it may be necessary to weld or otherwise lock the float shoe or collar, and even a few joints above them, to one another.

Certain prior U.S. patents suggest the mounting of springs or other parts about the bodies of float collars, float shoes, or similar apparatus for centering them within the well bore. However, to my knowledge, none have been commercially successful, and in my opinion, this apparent reluctance of the industry to adopt these prior proposals is due to their lack of strength, high cost of manufacture and other objections common to conventional centering parts, as discussed in my copending application. Furthermore, they would appear to be of such construction as to be susceptible to the same tendency of separate centralizers just above the shoe or collar to become unscrewed from the rest of the string.

It is therefore the object of this invention to provide a float shoe or float collar which will center itself within the well bore, but which, as compared with those of the prior art referred to above, is strong, relatively inexpensive to manufacture, and otherwise of a construction which is an improvement upon the prior art apparatus previously discussed, and further which is of such construction as to resist becoming unscrewed from the rest of the string.

This and other objects are accomplished, in accordance with the illustrated embodiment of this invention, by apparatus, either in the form of a float collar or a float shoe, which comprises, as in conventional apparatus of this type, an outer body having threads on its upper end for connection as part of the casing string, an inner body mounted within the outer body and having a vertical passageway therethrough, and valve means mounted on the inner body for closing the passageway as the string is lowered into the well bore, opening the passageway as cement is pumped downwardly through the passageway and into the annulus between the string and the well bore and then reclosing the passageway to prevent "U" tubing of the cement into the passageways when the pump is shut down. As in such prior apparatus, the inner body is formed of a material such as concrete which may be drilled out of the outer body, when the drill string has been cemented in the well bore, to fully open the string.

In accordance with the present invention, however, the outer body also includes metal blades which are formed integrally with the metal outer body and which extend longitudinally along the outside of the outer body beneath the threads. As a result, the float collar or float shoe, as the case may be, not only performs its ordinary function during the cementing operation, but, in addition, holds the lower end of the string in a centered position within the well bore. Consequently, there is no need for a separate centralizer to be connected near the float shoe or float collar, such that there is a reduction of costs of the overall casing string as well as a reduction in time and labor required to make up a separate centralizer in the string. More particularly, this is accomplished without any reduction in the strength of the float shoe or float collar itself, and further with relatively small added cost over that which would be incurred in the manufacture of the float collar or float shoe itself since the blades may be cast with the outer body or machined from bar stock with the outer body.

Since the blades extend longitudinally of the outer body, they provide only minimum interference to lowering of the casing string, and are automatically cleaned as the casing is run into the well bore. Also, the construction of the blades enables the float collar or float shoe to be centralized in an improved manner, in much the same manner previously discussed in connection with the centralizers of the aforementioned copending application. Still further, the solid construction of the blades will, upon hardening of the cement, tend to anchor the shoe or collar to the well bore and thus reduce the possibility f unscrewing from the rest of the string.

In the drawings, wherein like reference characters are used to indicate like parts:

Figure 1:
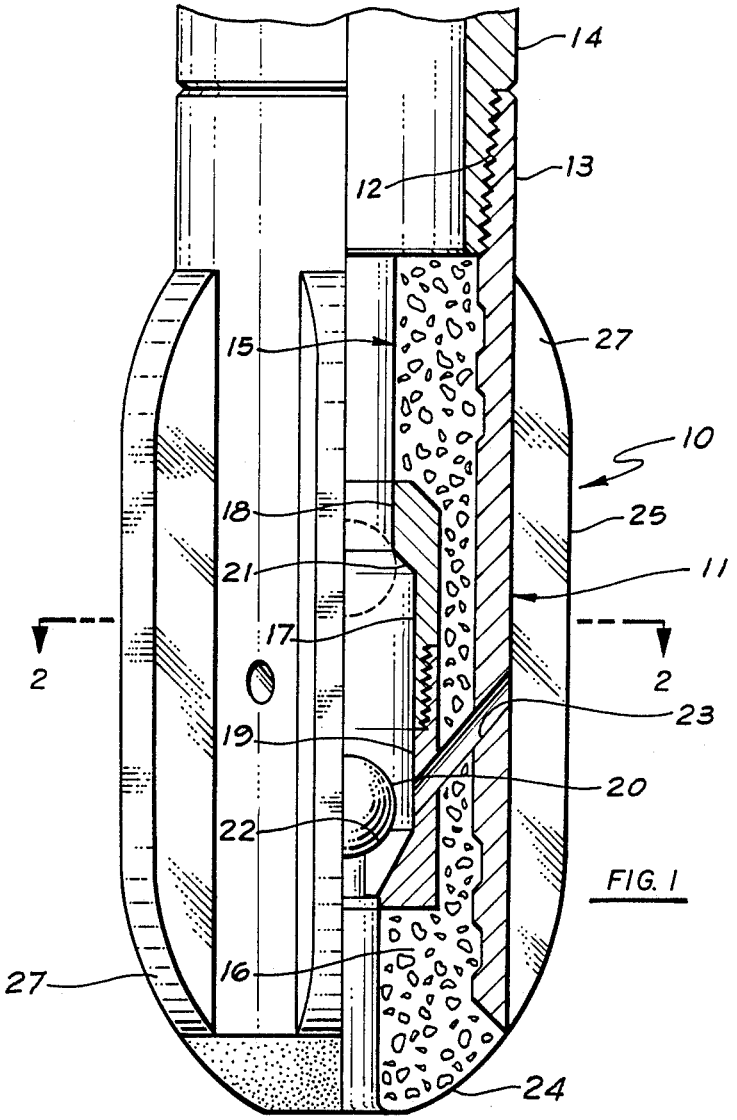
FIG. 1 is a view from the side of a float shoe constructed in accordance with the present invention, the left-hand portion thereof being shown in elevation and the right-hand portion thereof being shown in section.
Figure 2:
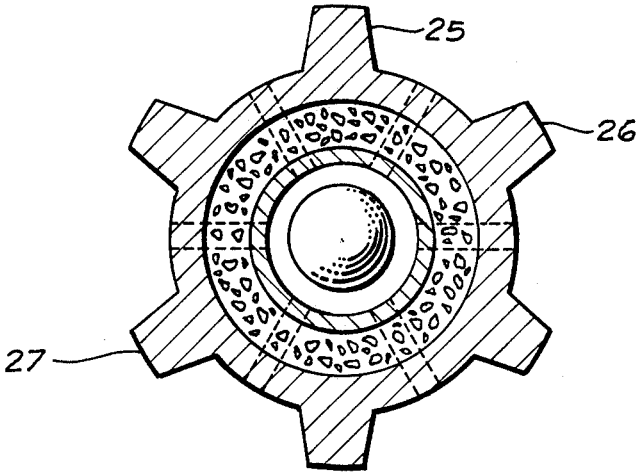
FIG. 2 is a horizontal sectional view of the float shoe of as seen along lines 2—2 of FIG. 1.

With reference now to the details of the above-described drawings, and particularly FIGS. 1 and 2, the float shoe shown therein, and designated in its entirety by reference character 10, comprises a tubular outer body 11 having female threads 12 about the inner diameter of its upper end 13 for connection with the lower end of a joint 14 of casing at the lower end of a casing string. As shown, the outer diameter of the tubular body is the same as that of the casing string to which it is connected and the inner diameter thereof is somewhat larger than the inner diameter of the casing string. Preferably, the outer body 11 is made of the same grade of steel as the casing string, thereby maintaining the strength and integrity of the string throughout its entire length.

As previously described, the float shoe also includes an inner body designated in its entirety by reference character 15 and including a tubular body 16 of concrete or other drillable material disposed about the inner diameter of the inner body beneath the threads 12 at its upper end. More particularly, the inner body also includes a sleeve 17 mounted within the intermediate portion of the inner diameter of the inner body 15, as by being cast within the concrete, which in turn is cast within the outer body.

The inner body has a passageway 18 which extends vertically therethrough in axial alignment with the center of the casing string thereabove. More particularly, the passageway 18 is of less diameter than the I.D. of the casing string, and the sleeve 17 has an enlarged inner diameter 19 intermediate its upper ends to receive a ball 20 for reciprocation vertically therein between a seat 21 about the upper end of the sleeve 17 and a cage 22 about the lower end thereof. The cage is of well known construction having slots formed therein to permit flow past the ball when it is in its lower seated position, as shown in solid lines in FIG. 1. However, upon raising of the ball into seated position into engagement with the seat 21, as shown in broken lines, the valve is closed to prevent flow through the passageway 18. As previously mentioned, both the sleeve and ball may be made of suitable plastic material well suited for this environment.

As previously described, and as is well known in the art of float shoes or collars of this general construction, when the casing string has been lowered to full depth, and the cement pumps are turned on, cement may be circulated downwardly through the casing string to lower the ball to open the valve and thus permit the cement to flow around the ball and through the cage 22, and thus out the lower end of the shoe or collar and upwardly within the annulus between the casing string and the well bore. Then, when the desired volume of cement has been pumped into the annulus, and the mud pumps are turned off, the hydrastatic pressure of the cement will force the ball upwardly to closed position, thus preventing the cement column from "U" tubing up into the casing string.

After the cement has hardened within the annulus, a suitable drilling tool may be lowered through the casing string to drill out the body of concrete and thus open the lower end of the string to full bore, as well as drill deeper into the well bore. In this way, the operator may pressure test the cement column before drilling into deeper formations. Or, if desired, the cemented casing string may be perforated for completion purposes.

As previously noted, the lower end of the body 16 of concrete extends beneath the lower end of the outer tubular body 11, and is rounded so as to provide a nose 24 which assists in guiding the casing string through obstructions which might exist in the well bore. Also, a plurality of ports 23 are formed through the outer body as well as the inner body to connect the passageway through the inner body with the outer diameter of the shoe. These ports permit the jetting of fluid therethrough, all for purposes well known in this art.

In accordance with the present invention, and as also previously described, and in accordance with the novel aspects of the present invention, a plurality of blades 25 extend longitudinally along the outside of the outer tubular body so as to center the float shoe, and thus the lower end of the casing string, within the well bore. Thus, the blades are of such radial extent that their outer edges 26 are adapted to lie close to the well bore. As shown, the blades are relatively thick to provide relatively wide surfaces along their outer edges. Also, their upper and lower ends are tapered inwardly as indicated at 27 so as to assist in guiding the shoe into and out of the well bore. More particularly, the blades are generally equally spaced apart about the circumference of the outer tubular member.

More particulary, and as also previously described, the blades are formed integrally with the outer tubular body, as by being cast therewith, or by machining of a piece of bar stock having the outer diameter of the edges 25. More particulary, the upper ends of the blades are beneath the threads 12 on the upper end 13 of the outer body and thus opposite the full thickness of the outer body for strength purposes.

Figure 3:
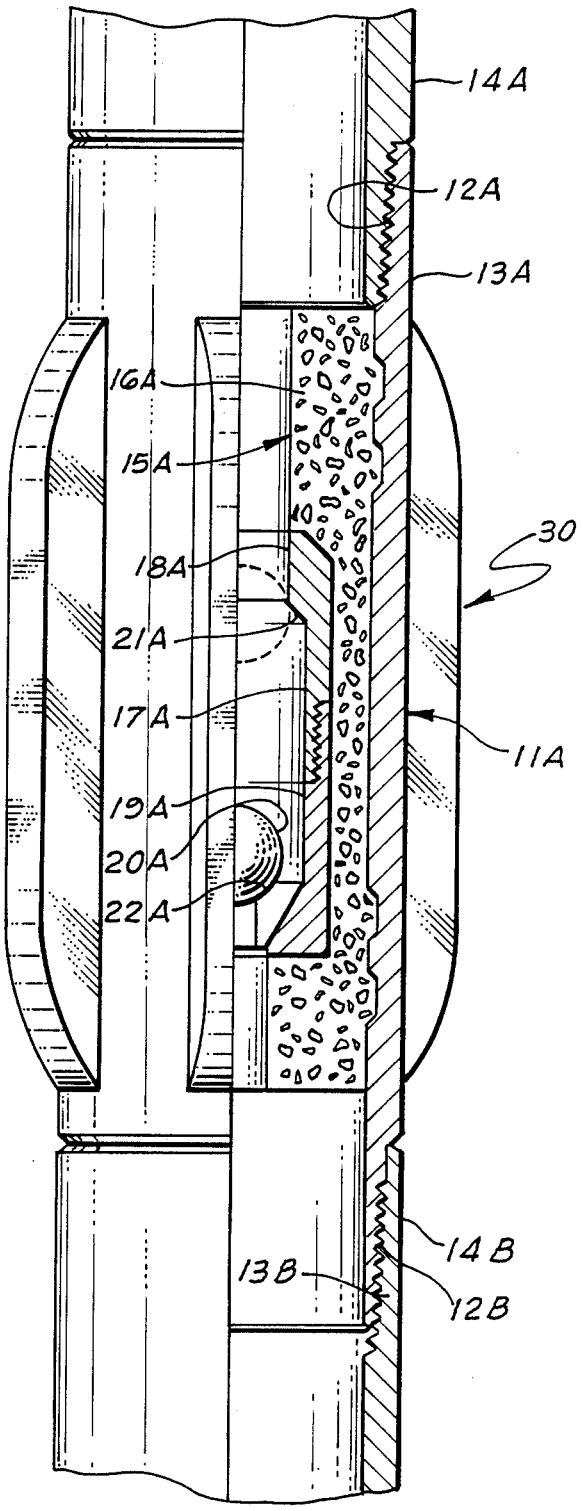
FIG. 3 is a side view of a float collar constructed in accordance with the present invention, the left-hand portion thereof being shown in elevation and the right-hand portion thereof being shown in section, as in the case of FIG. 3.

The float collar constructed in accordance with the present invention, and indicated in its entirety by reference character 30 in FIG. 3, is of similar construction to the float shoe 10, as indicated by the use of the same number to designate like parts except for the addition of the prefix "A". Thus, the float collar 30 includes an outer tubular body 11A having threads 12A about its upper end 13A for connection to a joint 14A of the casing thereabove. However, as compared with the float shoe, the body 11A has additional threads 12B on its lower end 13B for connection with the upper end of a lower joint 14B of the casing string. Thus, the float collar is not at the lower end of the casing string, but instead is connected at least one joint of casing above its lower end.

As will be apparent from the reference characters appearing on FIG. 3, the other parts of the float collar 30 making up its basic construction are similar to those making up the basic construction of the float shoe 10. It will also be understood that, as previously described, the float collar functions in substantially in the same way as the float shoe as the casing string is lowered to total depth within the well bore, and cement is circulated downwardly therethrough and into the annulus between the casing string and the well bore. Also, and again as in the case of the float shoe 11, the body 16A concrete or other drillable material of the float collar may be removed after the cement column has hardened so as to open the casing string to full bore.

Since the float collar is not disposed at the lower end of the casing string, and thus does not have to guide the casing string into the well bore, the lower end of the concrete body 16A need not extend below the lower end of the outer tubular body 11A, and in fact ends a relatively short distance between the lower end of the sleeve 17A in which the ball 20A reciprocates.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. Apparatus for use in cementing a casing string within a well bore, comprising a one piece, outer metal body having threads on its upper end for connection as part of the casing string, metal blades formed integrally with and extending along the outside of the outer body parallel to the axis thereof, an inner body mounted within the outer body and having a vertical passageway therethrough, and valve means mounted on the inner body intermediate the upper and lower ends of the outer body for closing the passageway as the string is lowered into the well bore but adapted to be opened as cement is pumped downwardly through the passageway and into the annulus between the string and the well bore, said inner body being formed of a material which may be drilled out of the outer body when the string has been cemented in the well bore, thus leaving the outer body and blades in place.

2. Apparatus of the character defined in claim 1, wherein the outer body has threads on its lower end beneath the blades so as to form a float collar connectible intermediate joints of the casing string.

3. Apparatus of the character defined in claim 1, wherein the inner body has a lower end which is rounded and extends below the lower end of the outer body so as to form a float shoe connectible to the lower end of the casing string.

4. Apparatus of the character defined in claim 1, wherein the valve means includes a downwardly facing seat and an upwardly facing cage about the passageway, and a ball shiftable vertically within the passageway between the seat and cage.

* * * * *